US007710368B2

(12) United States Patent
Chung

(10) Patent No.: US 7,710,368 B2
(45) Date of Patent: May 4, 2010

(54) EMISSION CONTROL DRIVER AND ORGANIC LIGHT EMITTING DISPLAY USING THE SAME

(75) Inventor: Bo Yong Chung, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1152 days.

(21) Appl. No.: 11/327,337

(22) Filed: Jan. 9, 2006

(65) Prior Publication Data

US 2006/0156121 A1 Jul. 13, 2006

(30) Foreign Application Priority Data

Jan. 10, 2005 (KR) ..... 10-2005-0002076

(51) Int. Cl.
*G09G 3/32* (2006.01)

(52) U.S. Cl. ..... 345/82; 345/76

(58) Field of Classification Search ..... 345/36, 345/38–39, 42, 45, 48, 50–53, 64, 76–77, 345/82–84, 87–88, 92, 99, 204, 211, 214; 315/169.3

See application file for complete search history.

(56) References Cited

U.S. PATENT DOCUMENTS

| | | | | |
|---|---|---|---|---|
| 6,845,140 | B2 | 1/2005 | Moon et al. | |
| 7,180,486 | B2 * | 2/2007 | Jeong | 345/82 |
| 7,187,351 | B2 * | 3/2007 | Kwon | 345/82 |
| 7,259,735 | B2 * | 8/2007 | Kasai | 345/77 |
| 7,414,599 | B2 * | 8/2008 | Chung et al. | 345/76 |
| 2004/0189584 | A1 | 9/2004 | Moon | |
| 2004/0196239 | A1 | 10/2004 | Kwon | |
| 2004/0217925 | A1 | 11/2004 | Chung et al. | |

FOREIGN PATENT DOCUMENTS

| | | |
|---|---|---|
| CN | 1312535 | 9/2001 |
| CN | 1549232 | 11/2004 |
| JP | 2001-506044 | 5/2001 |
| JP | 2002-203397 | 7/2002 |
| JP | 2004-133240 | 4/2004 |
| JP | 2004-310006 | 11/2004 |

* cited by examiner

*Primary Examiner*—Richard Hjerpe
*Assistant Examiner*—Mansour M Said
(74) *Attorney, Agent, or Firm*—H.C. Park & Associates, PLC

(57) ABSTRACT

An emission control driver compensates for the threshold voltages of transistors to provide uniform brightness using a plurality of emission control signal generating circuits.

23 Claims, 6 Drawing Sheets

EMISSION CONTROL DRIVER AND ORGANIC LIGHT EMITTING DISPLAY USING THE SAME

CROSS-REFERENCE TO RELATED APPLICATIONS

This application claims priority to and the benefit of Korean Patent Application No. 10-2005-0002076, filed on Jan. 10, 2005, which is hereby incorporated by reference for all purposes as if fully set forth herein.

BACKGROUND

1. Field of the Invention

The present invention relates to an emission control driver and an organic light emitting display using the same, and more particularly, to an emission control driver including emission control signal generating circuits that generate emission control signals using scan signals and an organic light emitting display using the same.

2. Discussion of the Background

An organic light emitting diode (OLED) may include a light emitting thin film emission layer arranged between a cathode electrode and an anode electrode. Electrons and holes are injected into the emission layer where they are recombined to emit light.

The emission layer of an OLED or IOLED may be formed of organic or inorganic material. OLEDs may be classified as either inorganic or organic according to the type of emission layer used.

FIG. 1 illustrates part of a conventional organic light emitting display. Referring to FIG. 1, a pixel includes an OLED and a pixel circuit. The pixel circuit includes a first transistor M1, a second transistor M2, and a capacitor Cst. Each of the first M1 and second M2 transistors includes a gate, a source, and a drain. The capacitor Cst includes a first electrode and a second electrode.

The source of the first transistor M1 is coupled with a power source supply line Vdd to receive a pixel power source, the drain of the first transistor M1 is coupled with the anode of the OLED, and the gate of the first transistor M1 is coupled with a first node A. The first node A is coupled with the drain of the second transistor M2. The first transistor M1 supplies current corresponding to a data signal to the OLED.

The source of the second transistor M2 is coupled with a data line Dm, the drain of the second transistor M2 is coupled with the first node A, and the gate of the second transistor M2 is coupled with a first scan line Sn. The second transistor M2 transmits the data signal to the first node A in accordance with the scan signal applied to the gate of the second transistor M2.

The first electrode of the capacitor Cst is coupled with the power source supply line Vdd and the second electrode of the capacitor Cst is coupled with the first node A. The capacitor Cst stores a predetermined voltage in response to the data signal and applies the stored voltage between the gate and source of the first transistor M1 for one frame so that the operation of the first transistor M1 is maintained for one frame.

In a pixel having the above structure, the voltage stored in the capacitor Cst is transmitted to the gate of the first transistor M1 so that current flows to the OLED through the first transistor M1. The voltage between the gate and source of the first transistor M1 and the current that flows to the OLED by the capacitor Cst correspond to EQUATION 1.

$$Vgs = Vdd - Vdata \qquad \text{[EQUATION 1]}$$

$$I_{OLED} = \frac{\beta}{2}(Vgs - Vth)^2 = \frac{\beta}{2}(Vdd - Vdata - Vth)^2$$

where Vgs represents the voltage between the gate and source of the first transistor M1, Vdd represents the voltage of the pixel power source, Vdata represents the voltage of the data signal, Vth represents the threshold voltage of the first transistor M1, and β represents the gain factor of the first transistor M1.

However, as represented in the EQUATION 1, the current that flows to the OLED corresponds to the threshold voltage of the first transistor M1. Therefore, non-uniformity in brightness may be due to non-uniformity in the threshold voltage of the first transistor M1 generated during the processes of fabricating the light emitting display. This may cause the picture quality of the display to deteriorate.

SUMMARY OF THE INVENTION

This invention provides an emission control driver that compensates for the threshold voltages of transistors to reduce non-uniformity in brightness and that includes emission control signal generating circuits that use less power to generate emission control signals using scan signals and an organic light emitting display using the same.

Additional features of the invention will be set forth in the description which follows, and in part will be apparent from the description, or may be learned by practice of the invention.

The present invention discloses an emission control driver, including a plurality of emission control signal generating circuits, each including first, second, and third scan lines transmitting first, second, and third scan signals; a first switching device transmitting a first voltage to an output port in accordance with at least one of the first scan signal and the second scan signal; a second switching device transmitting a second voltage to the output port in accordance with a voltage between a gate and source of the second switching device; a third switching device transmitting a voltage and making the voltage between the gate and source of the second switching device uniform in accordance with at least one of the first scan signal and the second scan signal; and a capacitor selectively turning on the second switching device in accordance with the third scan signal and maintaining the voltage between the gate and source of the second switching device.

The present invention also discloses an emission control driver, including a first switching device, including a first electrode connected to a first power source, a second electrode connected to an output port outputting emission control signals, a first gate connected to a first scan line transmitting a first scan signal, and a second gate connected to a second scan line transmitting a second scan signal; a second switching device, including a first electrode connected to the output port, a second electrode connected to a second power source, and a gate connected to a first node; a third switching device, including a first electrode connected to the second electrode of the first switching device, and a second electrode connected to the first node; a fourth switching device comprising, a first electrode connected to the first node, a second electrode connected to the second power source, and a gate connected to a third scan line transmitting a third scan signal; and a capacitor connected to the first node and connected to the output port.

The present invention also discloses a scan driver, including a shift register outputting a plurality of scan signals; and an emission control driver receiving the plurality of scan signals output from the shift register to generate emission control signals, wherein the emission control driver includes a plurality of emission control signal generating circuits, wherein the emission control signal generating circuits each include first, second, and third scan lines transmitting first, second, and third scan signals; a first switching device transmitting a first voltage to an output port in accordance with at least one of the first scan signal and the second scan signal; a second switching device transmitting a second voltage to the output port in accordance with a voltage between a gate and source of the second switching device; a third switching device transmitting a voltage and making the voltage between the gate and source of the second switching device uniform in accordance with at least one of the first scan signal and the second scan signal; and a capacitor selectively turning on the second switching device in accordance with the third scan signal and maintaining the voltage between the gate and source of the second switching device.

The present invention also discloses a scan driver including a shift register for outputting a plurality of scan signals; and an emission control driver receiving the plurality of scan signals output from the shift register to generate emission control signals, wherein the emission control driver includes a first switching device, including a first electrode connected to a first power source, a second electrode connected to an output port outputting emission control signals, a first gate connected to a first scan line transmitting a first scan signal, and a second gate connected to a second scan line transmitting a second scan signal; a second switching device, including a first electrode connected to the output port, a second electrode connected to a second power source, and a gate connected to a first node; a third switching device, including a first electrode connected to the second electrode of the first switching device, and a second electrode connected to the first node; a fourth switching device comprising, a first electrode connected to the first node, a second electrode connected to the second power source, and a gate connected to a third scan line transmitting a third scan signal; and a capacitor connected to the first node and connected to the output port.

The present invention also discloses an image display device, including an image display unit including a plurality of pixels; a data driver transmitting data signals to the image display unit; a scan driver transmitting scan signals and emission control signals to the image display unit; and a plurality of emission control signal generating circuits, wherein each emission control signal generating circuit includes first, second, and third scan lines transmitting first, second, and third scan signals; a first switching device transmitting a first voltage to an output port in accordance with at least one of the first scan signal and the second scan signal; a second switching device transmitting a second voltage to the output port in accordance with a voltage between a gate and source of the second switching device; a third switching device transmitting a voltage and making the voltage between the gate and source of the second switching device uniform in accordance with at least one of the first scan signal and the second scan signal; and a capacitor selectively turning on the second switching device in accordance with the third scan signal and maintaining the voltage between the gate and source of the second switching device.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
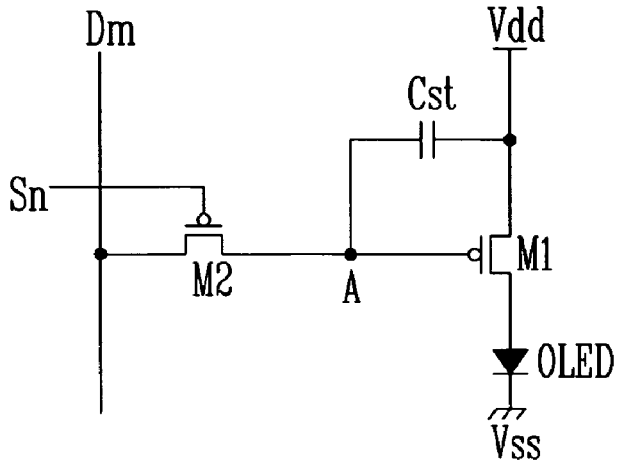
FIG. 1 (PRIOR ART)
FIG. 1 illustrates part of a conventional organic light emitting display.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

It will be understood that when an element such as a layer, film, region or substrate is referred to as being "on" another element, it can be directly on the other element or intervening elements may also be present. In contrast, when an element is referred to as being "directly on" another element, there are no intervening elements present.

Figure 2:
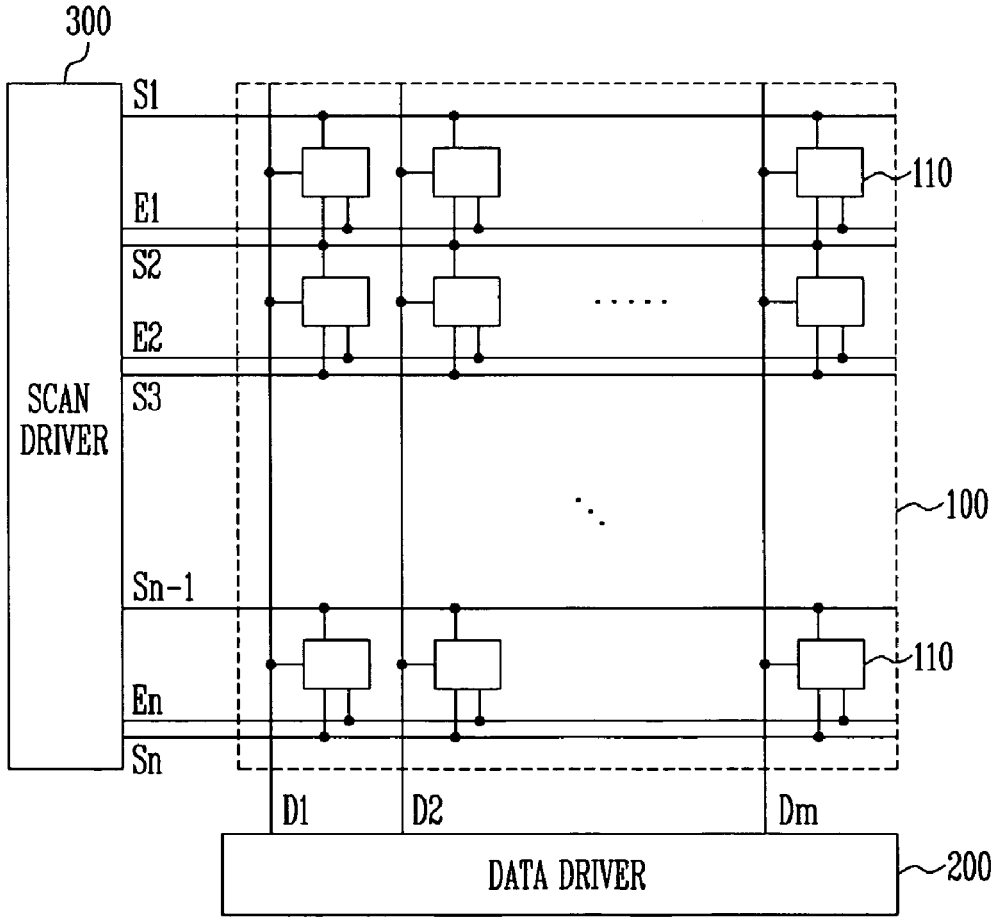
FIG. 2 illustrates the structure of an organic light emitting display according to an exemplary embodiment of the present invention.

FIG. 2 illustrates an organic light emitting display according to an exemplary embodiment of the present invention. Referring to FIG. 2, the organic light emitting display includes an image display unit 100, a data driver 200, and a scan driver 300.

The image display unit 100 includes a plurality of pixels 110 that include organic light emitting diodes (OLED), pixel circuits, a plurality of scan lines S1, S2, . . . , Sn−1, and Sn arranged in a row direction, a plurality of emission control lines E1, E2, . . . , En−1, and En, a plurality of data lines D1, D2, . . . , Dm-1, and Dm arranged in a column direction, and a plurality of pixel power source lines (not shown) for supplying pixel power sources.

In the image display unit 100, the scan signals transmitted from the scan lines S1, S2, . . . , Sn−1, and Sn and the data signals transmitted from the data lines D1, D2, . . . , Dm-1, and Dm are transmitted to the pixel circuits, the pixel circuits generate currents corresponding to the data signals, and the generated currents are transmitted to the OLEDs by the emission control signals transmitted by the emission control lines E1, E2, . . . , En−1, and En.

The data driver 200 is coupled with the data lines D1, D2, . . . , Dm-1, and Dm to transmit the data signals to the image display unit 100.

The scan driver 300 may be arranged on the side of the image display unit 100 and is coupled with the plurality of scan lines S1, S2, . . . , Sn−1, and Sn and the plurality of emission control lines E1, E2, . . . , En−1, and En to transmit the scan signals and the emission control signals to the image display unit 100. Light is emit from the pixels 110 due to the emission control signals. The data signals are applied to the pixels 110 selected by the scan signals.

The scan driver 300 may include a shift register for generating the scan signals and an emission control driver 310 (FIG. 3) to generate the emission control signals using the scan signals. The emission control driver 310 includes a plurality of emission control signal generating circuits. One emission control signal generating circuit receives three scan signals to output one emission control signal.

Figure 3:
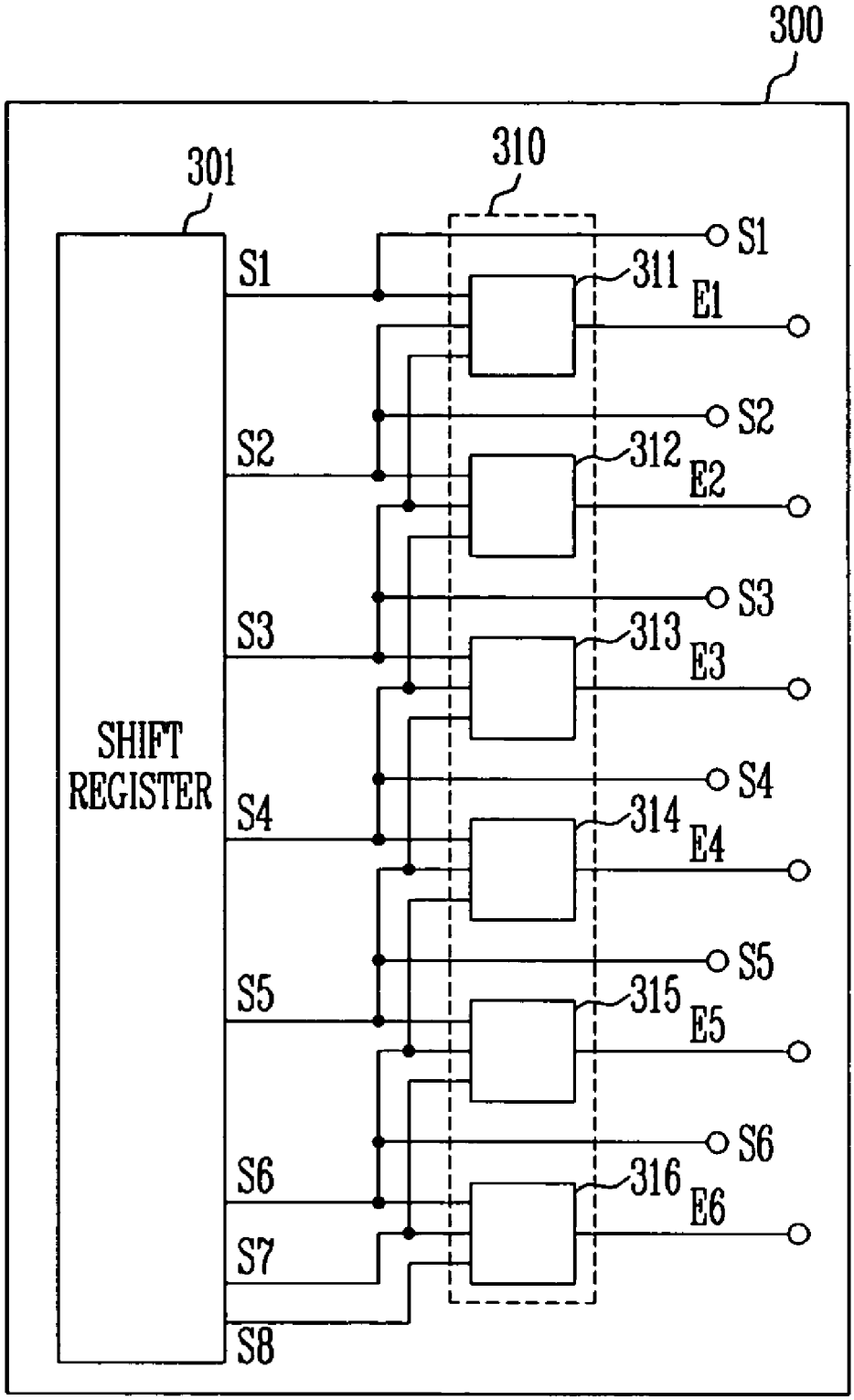
FIG. 3 illustrates a part of a scan driver used for the organic light emitting display according to an exemplary embodiment of the present invention.

FIG. 3 illustrates a portion of a scan driver used for the light emitting display according to an exemplary embodiment of the present invention. Referring to FIG. 3, the scan driver 300 may include a shift register 301 for outputting scan signals and an emission control driver 310 that receives the scan signals and uses the scan signals to output emission control signals.

The shift register 301 receives a start pulse and then sequentially shifts the start pulse to generate sequential pulse signals. The shift register 301 generates the scan signals using the pulse signals. The shift register 301 performs logical operations on the plurality of output pulse signals using logic gates, such as a NAND gate or a NOR gate, to produce the scan signals.

The emission control driver 310 includes a plurality of emission control signal generating circuits. One emission control signal generating circuit receives three scan signals to generate one emission control signal. The three scan signals may be three sequential scan signals. The emission control signal generating circuits may be described as first 311, second 312, third 313, fourth 314, fifth 315, and sixth 316 emission control signal generating circuits.

First s1, second s2, and third s3 scan signals are input to the first emission control signal generating circuit 311 to output a first emission control signal e1. Second s2, third s3, and fourth s4 scan signals are input to the second emission control signal generating circuit 312 to output a second emission control signal e2. Third s3, fourth s4, and fifth s5 scan signals are input to the third emission control signal generating circuit 313 to output a third emission control signal e3. Fourth 314, fifth 315, and sixth 316 emission control signal generating circuits output fourth e4, fifth e5, and sixth e6 emission control signals by a similar process.

The first s1, second s2, third s3, fourth s4, fifth s5, and sixth s6 scan signals are input to the image display unit 100 through additional lines without passing through the emission control signal generating circuits.

Figure 4:
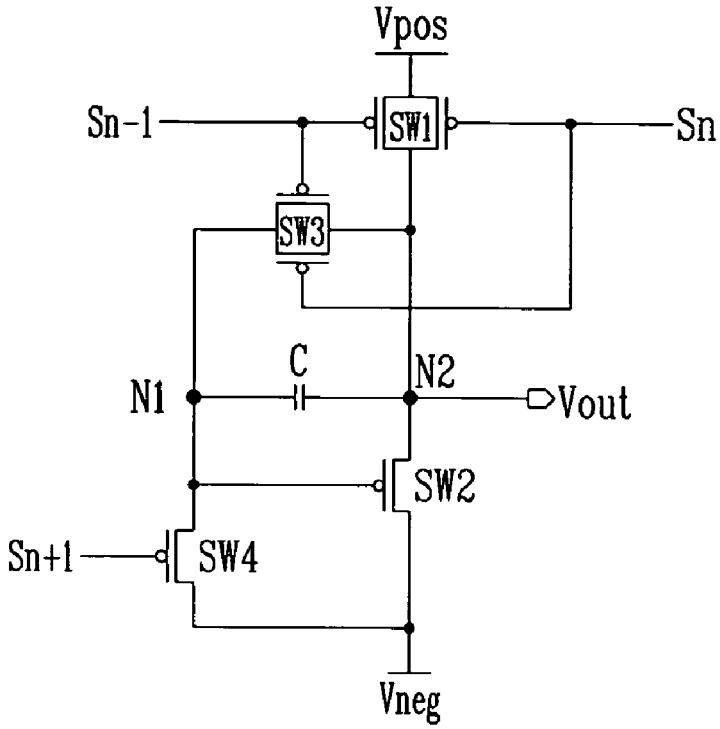
FIG. 4 is a circuit diagram illustrating a first exemplary embodiment of an emission control signal generating circuit used for an emission control driver according to an exemplary embodiment of the present invention.

FIG. 4 is a circuit diagram illustrating a first exemplary embodiment of an emission control signal generating circuit used for the emission control driver according to the present invention. Referring to FIG. 4, the emission control signal generating circuit includes a first switching device SW1 connected between a first power source Vpos and an output port N2, a second switching device SW2 connected between an output port N2 and a second power source Vneg, a capacitor C whose first electrode is coupled with the output port N2 and whose second electrode is coupled with a first node N1, which is coupled with the gate electrode of the second switching device SW2, a third switching device SW3 coupled with the first node N1, the output port N2, and the gate electrode of the first switching device SW1, and a fourth switching device SW4 coupled with the first node N1 and the second power source Vneg. The voltage level of the first power source Vpos may be higher than the voltage level of the second power source Vneg. Also, the first SW1, second SW2, third SW3, and fourth SW4 switching devices may be PMOS transistors and the first and third switching devices SW1 and SW3 may be formed of two transistors having a transmission gate structure combined with each other to include a source, a drain, and first and second gates. The second SW2 and fourth SW4 switching devices may each be formed of one transistor.

The source of the first switching device SW1 is coupled with the first power source Vpos and the drain of the first switching device SW1 is coupled with the output port N2. The first scan signal sn is transmitted to the first gate electrode of the first switching device SW1 and the second scan signal sn−1 is transmitted to the second gate electrode of the first switching device SW1. The first switching device SW1 forms a first path for supplying a first voltage to the output port N2 in accordance with the first sn or second sn−1 scan signal.

The gate of the second switching device SW2 is coupled with the first node N1, the source of the second switching device SW2 is coupled with the output port N2, and the drain of the second switching device SW2 is coupled with the second power source Vneg. The second switching device SW2 forms a second path for supplying the second power source Vneg to the output port N2 in accordance with the voltage of the first node N1, which is applied to the gate of the second switching device SW2. The voltage level of the first power source Vpos may be higher than the voltage level of the second power source Vneg.

The source of the third switching device SW3 is coupled with the output port N2, and the drain of the third switching device SW3 is coupled with the first node N1. The first scan signal sn is transmitted to the first gate of the third switching device SW3, and the second scan signal sn−1 is transmitted to the second gate of the third switching device SW3. The third switching device SW3 supplies the first power source Vpos supplied through the first switching device SW1 in accordance with the first sn or second sn−1 scan signal to the first node N1. Therefore, the third switching device SW3 is turned on by the first sn or second sn−1 scan signal in a low level to make the voltage between the gate and source of the second switching device SW2 uniform so that the second path formed by the second switching device SW2 is intercepted.

The source of the fourth switching device SW4 is coupled with the first node N1, the drain of the fourth switching device SW4 is coupled with the second power source Vneg, and the third scan signal sn+1 is transmitted to the gate of the fourth switching device SW4. The fourth switching device SW4 supplies a second voltage to the first node N1 in accordance with the third scan signal sn+1.

The capacitor C includes a first electrode coupled with the output port N2 and a second electrode coupled with the first node N1. The capacitor C stores the voltage between the gate and source of the second switching device SW2 in accordance with the switching operation of the fourth switching device SW4 and then switches on the second switching device SW2 with the stored voltage. The capacitor C keeps the second switching device SW2 turned on in accordance with the switching operation of the fourth switching device SW4 so that the second path is continuously maintained.

Figure 5:
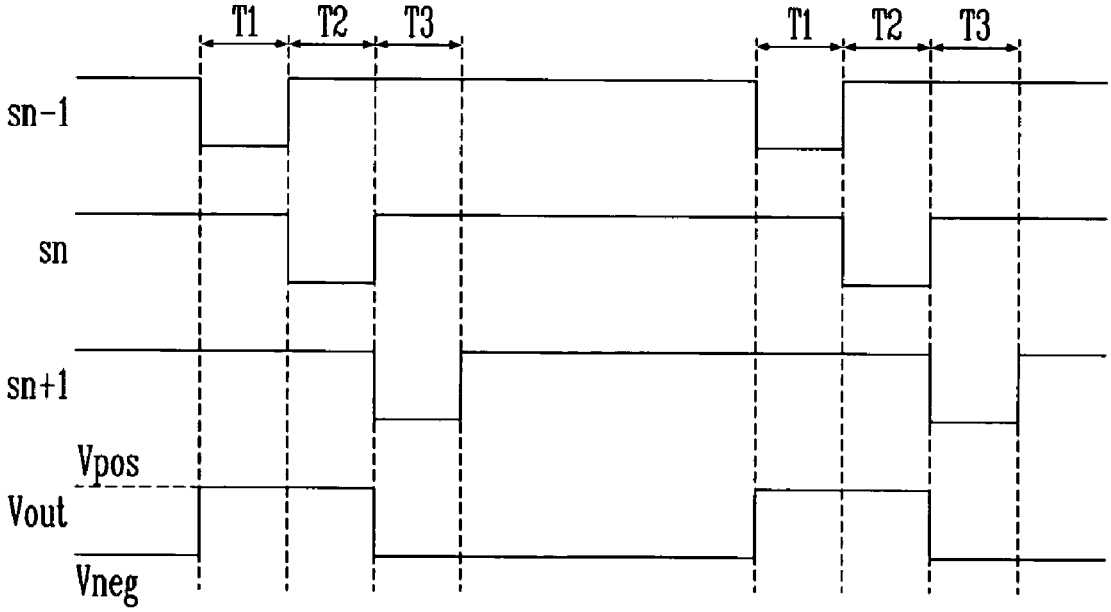
FIG. 5 is a timing diagram illustrating the operation of the emission control signal generating circuit of FIG. 4.

FIG. 5 is a timing diagram illustrating the operation of the emission control signal generating circuit of FIG. 4. Referring to FIG. 5, signals input to the emission control signal generating circuit 310 are used to output one emission control signal by the first sn−1, second sn, and third sn+1 scan signals output from the shift register 301 of the scan driver 300. The first scan signal sn selects a row so that a data signal is transmitted. The second scan signal sn−1 is input to a row that precedes the row to which the first scan signal sn is input by one row. The third scan signal sn+1 is input to a row that follows the row to which the first scan signal sn is input by one row.

In a first period T1 where the first sn and third sn+1 scan signals are input in a high level and the second scan signal sn−1 is input in a low level and in a second period T2 where the second sn−1 and third sn+1 scan signals are input in a high level, and the first sn scan signal is input in a low level, the first SW1 and third SW3 switching devices are turned on and the fourth switching device SW4 is turned off. Therefore, the first power source Vpos is transmitted to the output port N2 through the first switching device SW1 and is transmitted to the first node N1 through the first SW1 and third SW3 switching devices. Therefore, in the first period T1, the voltage level of the first power source Vpos is output to the output port N2.

The first power source Vpos is transmitted to the source and gate of the second switching device SW2 by the third switching device SW3 so that the voltage at the gate and source of the second switching device SW2 is equal. Therefore, the path between the source and drain of the second switching device SW2 is intercepted so that static current does not flow to the second power source Vneg through the output port N2 and the second switching device SW2, and the power consumption is reduced.

When the first sn and second sn−1 scan signals are input in a high level and the third scan signal sn+1 is input in a low level in the third period T3, the first SW1 and third SW3 switching devices are turned off and the fourth switching device SW4 is turned on.

When the fourth switching device SW4 is turned on, the voltage of the first node N1 is reduced so that voltage equal to or greater than the absolute value |Vth| of the threshold voltage of the second switching device SW2 is applied between the second terminal and the first terminal of the capacitor C, that is, between the source and gate of the second switching device SW2. Therefore, the second switching device SW2 is turned on.

Then, the voltage of the first node N1 is continuously reduced so that the voltage between the source and gate of the fourth switching device SW4 becomes less than the absolute value of the threshold voltage of the fourth switching device SW4. Therefore, the fourth switching device SW4 is turned off.

When the fourth switching device SW4 is turned off, the first terminal of the capacitor C floats so that the voltage stored in the capacitor C is maintained. Therefore, because the voltage stored between the second terminal and the first terminal of the capacitor C is equal to or greater than the absolute value of the threshold voltage of the second switching device SW2, the second switching device SW2 is kept on so that the voltage of the output port N2 reaches the voltage level of the second power source Vneg. Therefore, the voltage level of the second power source Vneg is full-downed, that is, the voltage outputted from the output terminal N2 reaches the second voltage Vneg to keep the second switching device turned on.

Furthermore, the voltage level of the first power source Vpos becomes the voltage level of the emission control signal en when the emission control signal en is output in a high level and the voltage level of the second power source Vneg becomes the voltage level of the emission control signal en when the emission control signal en is output in a low level.

According to the emission control signal generating circuit of the exemplary embodiment of the present invention described above, while the voltage level of the first power source Vpos is output using the third switching device SW3, the path of the static current of the second switching device SW2 is intercepted to reduce loss of current. Also, the second switching device SW2 is kept on using the capacitor C to output a voltage level of the second power source Vneg that is full-downed.

As a result, the desired voltage levels of the first power source and the second power source can be output. Also, the loss of current caused by the static current of the PMOS transistors is reduced so that power consumption is reduced. Also, the emission control signals output by the emission control signal generating circuit fully swing between the voltage level of the first power source and the voltage level of the second power source so that the image display unit 100 will perform its operations properly.

Figure 6:
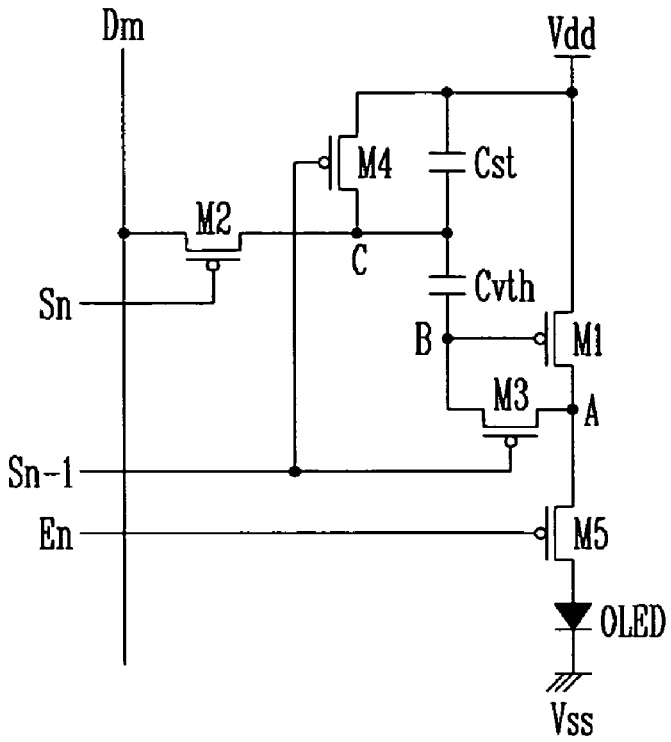
FIG. 6 is a circuit diagram illustrating a pixel used for the organic light emitting display according to an exemplary embodiment of the present invention.

FIG. 6 is a circuit diagram illustrating a first embodiment of a pixel used for the organic light emitting display according to an exemplary embodiment of the present invention. Referring to FIG. 6, the pixel includes an OLED and a pixel circuit. Each pixel circuit includes first M1, second M2, third M3, fourth M4, and fifth M5 transistors, a first capacitor Cst, and a second capacitor Cvth.

Each of the first M1, second M2, third M3, fourth M4, and fifth M5 transistors includes a source, a drain, and a gate. The first M1, second M2, third M3, fourth M4, and fifth M5 transistors may be formed of PMOS transistors. Each source and drain of the transistors may be referred to as a first electrode and a second electrode, because the sources and drains have no physical difference. The first capacitor Cst and the second capacitor Cvth each include a first electrode and a second electrode.

The source of the first transistor M1 is coupled with the pixel power source line Vdd to receive a pixel power source, and the drain of the first transistor M1 is coupled with a first node A so that the amount of current that flows from the source to the drain of the first transistor M1 is determined in accordance with the voltage from a second node B applied to the gate of the first transistor M1.

The source of the second transistor M2 is coupled with the data line Dm, the drain of the second transistor M2 is coupled with a third node C, and the gate of the second transistor M2 is coupled with the first scan line Sn so that the second transistor M2 performs on and off operations by the first scan signal sn transmitted through the first scan line Sn to selectively transmit the data signal to the third node C.

The source of the third transistor M3 is coupled with the first node A, the drain of the third transistor M3 is coupled with the second node B, and the gate of the third transistor M3 is coupled with the second scan line Sn−1 so that the third transistor M3 performs on and off operations by the second scan signal sn−1 transmitted through the second scan line Sn−1 to selectively make the potential of the first node A equal to the potential of the second node B. This will allow electric current to flow through the first transistor M1 so that the first transistor M1 operates as a diode.

The source of the fourth transistor M4 is coupled with the pixel power source line Vdd, the drain of the fourth transistor M4 is coupled with the third node C, and the gate of the fourth transistor M4 is coupled with the second scan line Sn−1 so that the fourth transistor M4 selectively transmits the pixel power source to the third node C in accordance with the second scan signal sn−1.

The source of the fifth transistor M5 is coupled with the first node A, the drain of the fifth transistor M5 is coupled with the OLED, and the gate of the fifth transistor M5 is coupled with the emission control line En so that the fifth transistor M5 performs on and off operations by the emission control signal en received through the emission control line En to allow the current to flow through the first node A to the OLED.

The first electrode of the capacitor Cst is coupled with the pixel power source line Vdd and the second electrode of the capacitor Cst is coupled with the third node C so that the capacitor Cst selectively stores the voltage value that amounts to the difference in voltage between the pixel power source line Vdd and the third node C by the fourth transistor M4.

The first electrode of the second capacitor Cvth is coupled with the third node C and the second electrode of the second capacitor Cvth is coupled with the second node B so that the second capacitor Cvth stores the voltage that amounts to the difference in voltage between the third node C and the second node B.

Figure 7:
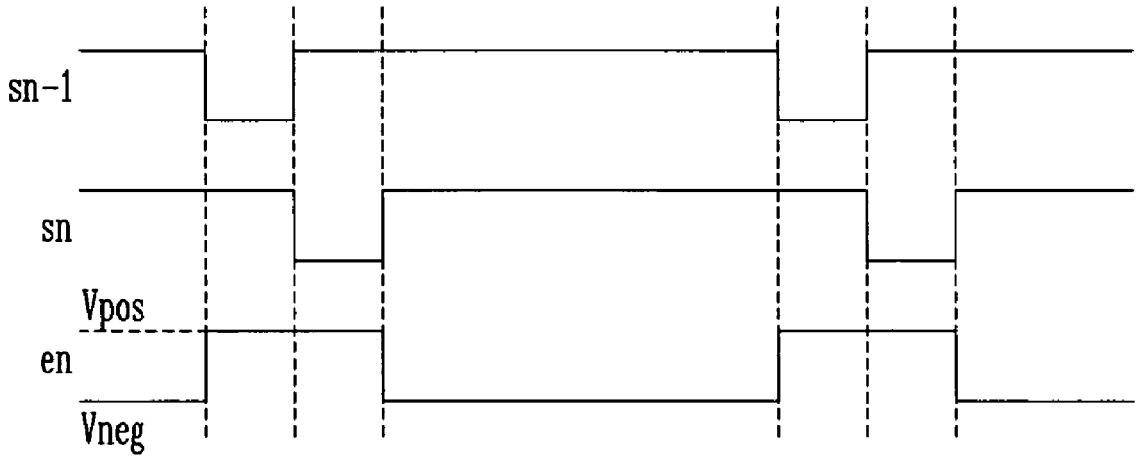
FIG. 7 is a timing diagram illustrating the operation of the pixel illustrated in FIG. 6.

FIG. 7 is a timing diagram illustrating the operation of the pixel illustrated in FIG. 6. Referring to FIG. 7, the pixel is operated by the first sn and second sn−1 scan signals, the data signal, and the emission control signal en. The first sn and second sn−1 scan signals and the emission control signal en are periodical signals. The voltage level of the emission control signal en in a high level corresponds to the voltage level of the first power source Vpos. The voltage level of the emission control signal en in a low level corresponds to the voltage level of the second power source Vneg.

First, the third M3 and fourth M4 transistors are turned on by the second scan signal sn−1 so that electric current flows through the first transistor M1, which operates as a diode, and so that the pixel power source is transmitted to the first electrode of the second capacitor Cvth. At this time, the voltage corresponding to the difference between the pixel power source and the threshold voltage of the first transistor M1 is applied to the second node B so that the voltage corresponding to the threshold voltage of the first transistor M1 is stored in the second capacitor Cvth.

When the second transistor M2 is turned on by the first scan signal sn, the data signal is transmitted to the third node C and to the second electrode of the first capacitor Cst. The pixel power source is transmitted to the first electrode of the first capacitor Cst so that the voltage corresponding to the difference in voltage between the pixel power source and the data signal Vdd-Vdata is stored in the first capacitor Cst.

Therefore, the voltage corresponding to EQUATION 2 is applied between the gate and source of the first transistor M1 by the first capacitor Cst and the second capacitor Cvth, which are serially coupled with each other.

$$Vgs = Vdd - (V\text{data} - |Vth|) \quad \text{[EQUATION 2]}$$

wherein, Vgs represents the voltage between the gate and source of the first transistor M1, Vdd represents the voltage of the pixel power source, Vdata represents the voltage of the data signal, and Vth represents the threshold voltage of the first transistor M1.

Therefore, the current that flows from the source to the drain of the first transistor M1 corresponds to EQUATION 3.

$$\begin{aligned} I &= \frac{\beta}{2}(Vgs - |Vth|)^2 \\ &= \frac{\beta}{2}(Vdd - (Vdata - |Vth|) - |Vth|)^2 \\ &= \frac{\beta}{2}(Vdd - Vdata)^2 \end{aligned} \quad \text{[EQUATION 3]}$$

wherein, Vgs represents the voltage between the gate and source of the first transistor M1, Vdd represents the voltage of the pixel power source, Vdata represents the voltage of the data signal, Vth represents the threshold voltage of the first transistor M1, and β represents the gain factor of the first transistor M1.

Therefore, current flows from the source to the drain of the first transistor M1 regardless of the threshold voltage of the first transistor M1. This allows the current to flow to the first node A.

The fifth transistor M5 is turned on by the emission control signal en to allow the current to flow through the first node A to the OLED. The emission control signal en fully swings between the first voltage level Vpos and the second voltage level Vneg so that the fifth transistor M5 operates properly to cause the OLED to emit light correctly.

Figure 8:
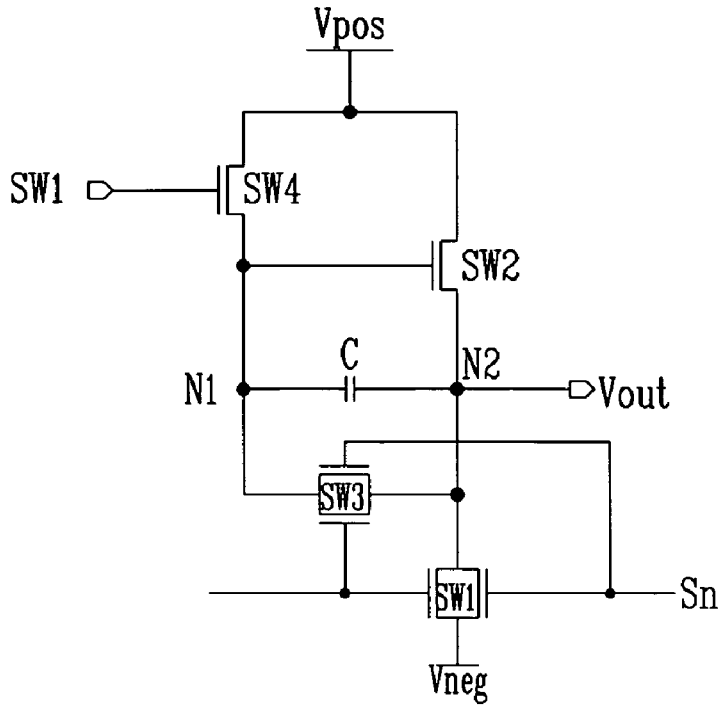
FIG. 8 is a circuit diagram illustrating an emission control signal generating circuit used for the emission control driver according to an exemplary embodiment of the present invention.
Figure 9:
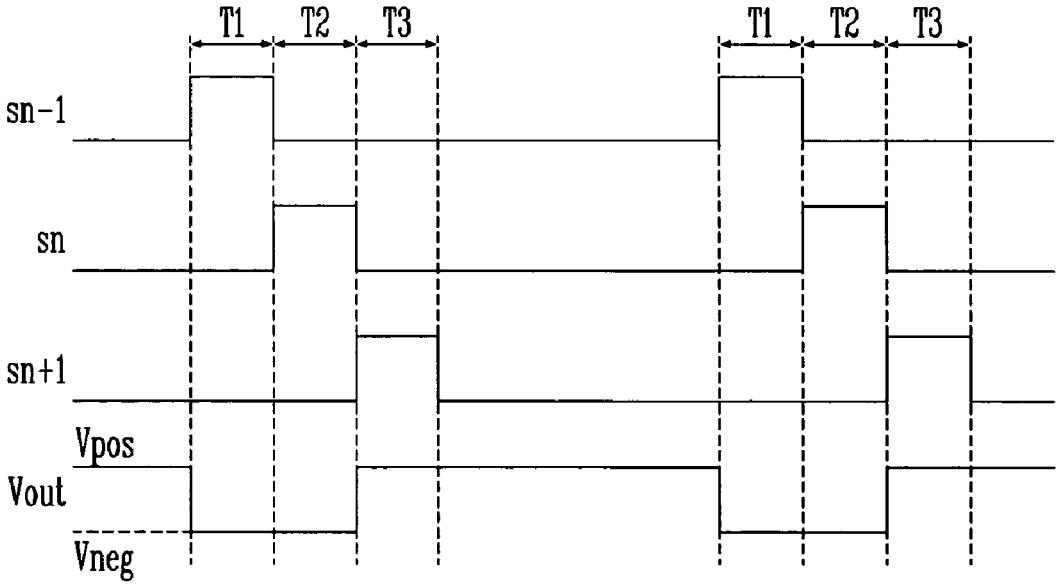
FIG. 9 is a timing diagram illustrating the operation of the emission control signal generating circuit of FIG. 8.

In another exemplary embodiment of the present invention, the emission control signal generating circuit used for the emission control driver may be formed of an NMOS transistor as illustrated in FIG. 8. When signals are input as illustrated in FIG. 9, the emission control signal generating circuit outputs an emission control signal that fully swings between the first voltage level and the second voltage level.

Figure 10:
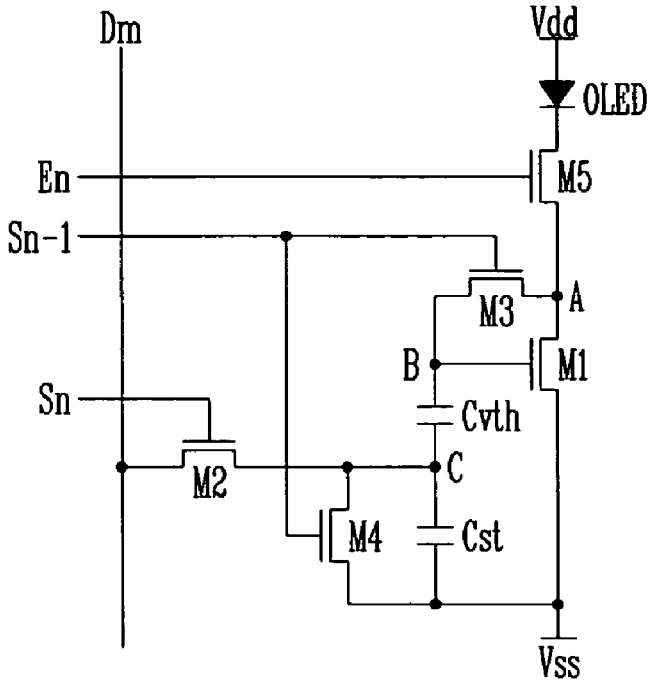
FIG. 10 is a circuit diagram illustrating a pixel used for the organic light emitting display according to an exemplary embodiment of the present invention.
Figure 11:
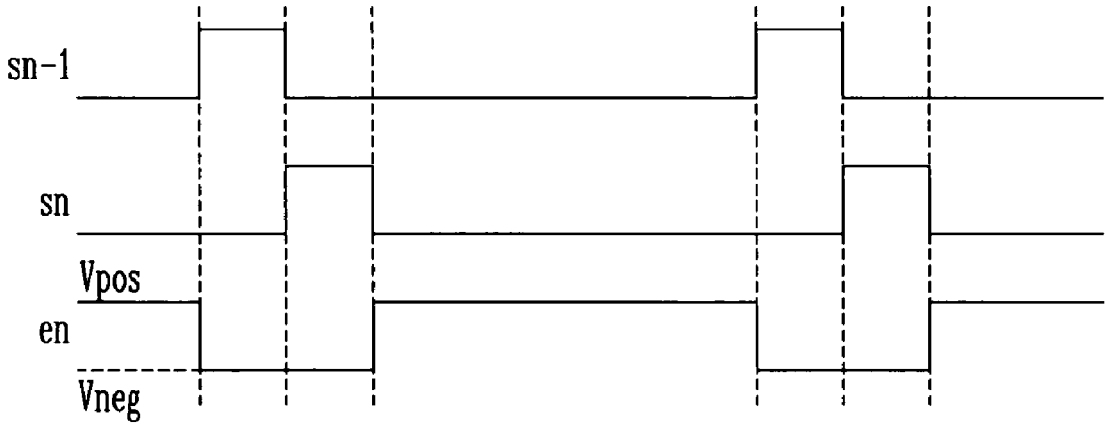
FIG. 11 is a timing diagram illustrating the operation of the pixel illustrated in FIG. 10.

When the pixels of the image display unit 100 are formed of NMOS transistors as illustrated in FIG. 10, and when the signals illustrated in FIG. 11 are input, the pixels 110 emit light by the current obtained by compensating for the threshold voltage.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An emission control driver receiving a first scan signal, a second scan signal, and a third scan signal, the driver comprising:

a plurality of emission control signal generating circuits, wherein an emission control generating circuit comprises:

a first switching device to transmit a first voltage to an output port in accordance with at least one of the first scan signal and the second scan signal;

a second switching device comprising a gate, a source and a drain, the second switching device to transmit a second voltage to the output port in accordance with a voltage between the gate and the source;

a third switching device to make the voltage at the gate and at the source of the second switching device uniform in accordance with at least one of the first scan signal and the second scan signal; and a capacitor to selectively turn on the second switching device in accordance with the third scan signal and to maintain a voltage between the gate and the source of the second switching device.

2. The emission control driver of claim 1, further comprising:

a fourth switching device to selectively turn on the second switching device in accordance with the third scan signal.

3. The emission control driver of claim 2, wherein the fourth switching device is turned on after the first switching device and the third switching device are turned on by the first scan signal, the second scan signal, or the third scan signal.

4. The emission control driver of claim 2, wherein the first switching device, the second switching device, the third switching device, and the fourth switching device all comprise either PMOS transistors or NMOS transistors.

5. The emission control driver of claim 2, wherein the capacitor stores the voltage between the gate and the source of the second switching device when the fourth switching device is turned on, and wherein the capacitor keeps the second switching device turned on using the stored voltage.

6. The emission control driver of claim 1, wherein the first switching device and the third switching device comprise a transmission gate.

7. An emission control driver, comprising:

a first switching device comprising, a first electrode connected to a first power source, a second electrode connected to an output port to output emission control signals, a first gate connected to a first scan line to transmit a first scan signal, and a second gate connected to a second scan line to transmit a second scan signal;

a second switching device comprising, a first electrode connected to the output port, a second electrode connected to a second power source, and a gate connected to a first node;

a third switching device comprising, a first electrode connected to the second electrode of the first switching device, and a second electrode connected to the first node;

a fourth switching device comprising, a first electrode connected to the first node, a second electrode connected to the second power source, and a gate connected to a third scan line to transmit a third scan signal; and a capacitor connected to the first node and connected to the output port.

8. The emission control driver of claim 7, wherein the first scan signal is input to a row of pixels in an image display unit, wherein the second scan signal is input to a row of pixels in the image display unit that precedes the row to which the first scan signal is input, and wherein the third scan signal is input to a row of pixels in the image display unit that succeeds the row to which the first scan signal is input.

9. The emission control driver of claim 7, wherein the first power source is output to the output port when the first switching device and the third switching device are turned on and the fourth switching device is turned off.

10. The emission control driver of claim 7, wherein the capacitor stores a voltage at which electric current flows through the second switching device, and wherein the output port outputs the second power source when the first switching device and the third switching device are turned off and the fourth switching device is turned on.

11. A scan driver, comprising:

a shift register to output a plurality of scan signals; and an emission control driver to receive the plurality of scan signals output from the shift register to generate emission control signals, wherein the emission control driver comprises a plurality of emission control signal generating circuits that receive a first scan signal, a second scan signal, and a third scan signal, wherein an emission control signal generating circuit comprises:

a first switching device to transmit a first voltage to an output port in accordance with at least one of the first scan signal and the second scan signal;

a second switching device comprising a gate, a source and a drain, the second switching device to transmit a second voltage to the output port in accordance with a voltage between the gate and the source;

a third switching device to make the voltage between the gate and the source of the second switching device uniform in accordance with at least one of the first scan signal and the second scan signal; and a capacitor to selectively turn on the second switching device in accordance with the third scan signal and to maintain a voltage between the gate and the source of the second switching device.

12. The scan driver of claim 11, further comprising:

a fourth switching device to selectively turn on the second switching device in accordance with the third scan signal.

13. The scan driver of claim 12, wherein the fourth switching device is turned on after the first switching device and the third switching device are turned on by the first signal, the second scan signal, or the third scan signals.

14. The scan driver of claim 11, wherein the capacitor stores the voltage between the gate and the source of the second switching device when the fourth switching device is turned on, and wherein the capacitor keeps the second switching device turned on using the stored voltage.

15. The scan driver of claim 11, wherein the first switching device and the third switching device comprise a transmission gate.

16. A scan driver, comprising:

a shift register to output a plurality of scan signals; and an emission control driver to receive the plurality of scan signals output from the shift register to generate emission control signals, wherein the emission control driver comprises:

a first switching device comprising, a first electrode connected to a first power source, a second electrode connected to an output port to output emission control signals, a first gate connected to a first scan line to transmit a first scan signal, and a second gate connected to a second scan line to transmit a second scan signal;

a second switching device comprising, a first electrode connected to the output port, a second electrode connected to a second power source, and a gate connected to a first node;

a third switching device comprising, a first electrode connected to the second electrode of the first switching device, and a second electrode connected to the first node;

a fourth switching device comprising, a first electrode connected to the first node, a second electrode connected to the second power source, and a gate connected to a third scan line to transmit a third scan signal; and a capacitor connected to the first node and connected to the output port.

17. The scan driver of claim 16, wherein the first scan signal is input to a row of pixels in an image display unit, wherein the second scan signal is input to a row of pixels in the image display unit that precedes the row to which the first scan signal is input, and wherein the third scan signal is input to a row of pixels in the image display unit succeeds the row to which the first scan signal is input.

18. The scan driver of claim 16, wherein the first power source is output to the output port when the first switching device and the third switching device are turned on and the fourth switching device is turned off.

19. The scan driver of claim 16, wherein the capacitor stores a voltage at which electric current flows through the second switching device, and wherein the output port outputs the second power source when the first switching device and the third switching device are turned off and the fourth switching device is turned on.

20. An image display device, comprising:

an image display unit comprising a plurality of pixels;

a data driver to transmit data signals to the image display unit;

a scan driver to transmit scan signals and emission control signals to the image display unit; and a plurality of emission control signal generating circuits that receive a first scan signal, a second scan signal, and a third scan signal, wherein an emission control signal generating circuit comprises:

a first switching device to transmit a first voltage to an output port in accordance with at least one of the first scan signal and the second scan signal;

a second switching device comprising a gate, a source and a drain, the second switching device to transmit a second voltage to the output port in accordance with a voltage between the gate and the source;

a third switching device to make the voltage at the gate and at the source of the second switching device uniform in accordance with at least one of the first scan signal and the second scan signal; and a capacitor to selectively turn on the second switching device in accordance with the third scan signal and to maintain the voltage between the gate and the source of the second switching device.

21. The image display device of claim 20, further comprising:

a fourth switching device to selectively turn on the second switching device in accordance with the third scan signal.

22. The image display device of claim 21, wherein the fourth switching device is turned on after the first switching device and the third switching device are turned on by the first scan signal, the second scan signal, or the third scan signal.

23. The image display device of claim 21, wherein the capacitor stores the voltage between the gate and the source of the second switching device when the fourth switching device is turned on, and wherein the capacitor keeps the second switching device turned on using the stored voltage.

* * * * *